US006085632A

United States Patent [19]

Stoll et al.

[11] Patent Number: 6,085,632

[45] Date of Patent: Jul. 11, 2000

[54] APPARATUS FOR THE DAMPED POSITIONING OF A PISTON

[75] Inventors: Kurt Stoll, Esslingen; Gerhard Gommel, Notzingen; Jürgen Arbter, Waiblingen; Reinhard Schwenzer, Esslingen, all of Germany

[73] Assignee: Festo AG & Co., Esslingen, Germany

[21] Appl. No.: 09/225,455

[22] Filed: Jan. 6, 1999

[30] Foreign Application Priority Data

Jan. 16, 1998 [DE] Germany ..... 198 01 338

[51] Int. Cl.[7] ..... F15B 13/16

[52] U.S. Cl. ..... 91/361; 91/459

[58] Field of Search ..... 91/361, 363 R, 91/363 A, 459

[56] References Cited

U.S. PATENT DOCUMENTS

| | | | |
|---|---|---|---|
| 4,951,549 | 8/1990 | Olsen et al. | 91/361 X |
| 5,012,722 | 5/1991 | McCormick | 91/361 |
| 5,491,422 | 2/1996 | Bitar et al. | 91/361 X |
| 5,617,723 | 4/1997 | Hosseini et al. | 91/361 X |

FOREIGN PATENT DOCUMENTS

| | | | |
|---|---|---|---|
| 4201 464 | 7/1994 | Germany . | |
| 0103102 | 8/1980 | Japan | 91/361 |
| 1216101 | 8/1989 | Japan | 91/361 |

OTHER PUBLICATIONS

Backé, W., Servohydraulik Aug. 5, 1986, pp. 183, 228, 251–254.

*Primary Examiner*—Hoang Nguyen
*Attorney, Agent, or Firm*—Hoffmann & Baron LLP

[57] ABSTRACT

An apparatus for the damped positioning of a piston running in a cylinder at one fixed abutment at least and more particularly for setting in a terminal position. The apparatus includes sensor means connected with an electronic regulating means for detecting the piston position as an actual value signal. A valve means adapted to be regulated by the regulating means serves for regulated braking of the piston prior to reaching the respective desired position by influencing opposing pressure in the cylinder outlet side. For forming the setting quantity for the proportional valve a position regulating means is provided which is modified by a value dependent on the respective speed and/or acceleration of the piston. This apparatus ensures an extremely accurate regulation of position simply by detecting of the position of the piston as an actual value signal. It is more particularly possible to brake the piston in the terminal positions with a damping action that an additional damping system is no longer necessary.

19 Claims, 1 Drawing Sheet

APPARATUS FOR THE DAMPED POSITIONING OF A PISTON

BACKGROUND OF THE INVENTION

The invention relates to an apparatus for the damped positioning of a piston running in a cylinder at one fixed abutment at least and more particularly for setting in a terminal position, comprising sensor means connected with an electronic regulating means for detecting the piston position as an actual value signal and with a valve arrangement adapted to be regulated by the regulating means for regulated braking of the piston prior to reaching the respective desired position by influencing opposing pressure in the cylinder outlet side.

THE PRIOR ART

In the case of a device of this type disclosed in the German patent publication 4,201,464 C2 the desired variations in speed are preset in order to produce the desired braking action prior to reaching the desired position. However, it has been seen from experience that such braking is extremely hard to perform with the desired speed and with a reasonable amount of complexity of the regulation means.

SHORT SUMMARY OF THE INVENTION

One object of the invention is accordingly to create an apparatus with an improved regulation of braking, which may be manufactured simply and with a relatively high degree of precision.

In order to achieve these and/or other objects appearing from the present specification, claims and drawings, in the present invention for forming the setting quantity for the proportional valve a position regulating means is provided, which is modified by a value dependent on the respective speed and/or acceleration of the piston.

The invention thus provides a simple position regulation means, which acts on the proportional valve, speed- and acceleration-dependent components being added as correction factors or additives in order to obtain an optimum braking performance. The electronic regulator is thus designed as a triple-loop state regulator. Owing to not having mechanical, pneumatic or hydraulic damping means higher cycle rates may be achieved. Mechanical damping devices and more particularly those for terminal position damping, may be completely dispensed with.

The features of the invention recited in the claim are advantageous further developments and improvements in the invention.

The position error signal is linked with the value dependent on the acceleration and the value dependent on the acceleration preferably additively or subtractively. In this respect the speed and the acceleration do not need to be separately detected, and in fact the value dependent on the speed is derived by differentiating the actual value of the position signal and the value dependent on the acceleration is derived by differentiating the value dependent on the speed, for which purpose merely simple differentiating elements are required or the differentiation may be performed by a microcomputer, which is in any case present.

The value dependent on the speed and/or the value dependent on acceleration and/or the value of the modified error signal are in a preferred embodiment of the invention linked multiplicatively with a regulation gain factor. The adjustment of the regulation gain factors may here be for example performed by setting members on the basis of tables, factors such as moving masses, lengths of paths of movement, type of cylinder or the like being taken into account if desired.

The value of the modified error signal may however be linked in an advantageous manner with an offset value additively or subtractively so that it is even possible to take into account factors arising later on, such as aging factors or the like, in a simple manner.

As a valve arrangement a proportional valve is more especially suitable, such as more particularly a 5/3 proportional valve. Such a valve arrangement is best functionally connected with the two end portions of the cylinder, such connection being more especially with the aid of suitable pressure lines.

In order to affect the drive pressure on the inflow side and/or the opposing pressure on the outflow side it is an advantage to modify the cross section on the inflow and, respectively, outflow sides and/or to produce a connection with a source of an opposing pressure.

For automatically detecting the two terminal positions it is best for the electronic regulating means to have a first learn mode for detecting the terminal positions. In this respect first control means are provided for sequentially approaching the two terminal positions and for storage of the terminal positions detected in the corresponding abutment positions.

In addition it is possible for the electronic regulating means to further have a second learn mode for setting optimum braking behavior. The adaptation means that the operating behavior is optimized, the adjustment preferably being performed suitably presetting the regulation gains, which are automatically set. Adjustment may as an alternative, or in addition, be carried out by the automatic presetting of the offset value.

Further advantageous developments and convenient forms of the invention will be understood from the following detailed descriptive disclosure of one embodiment thereof in conjunction with the accompanying drawings.

LIST OF THE SEVERAL VIEWS OF THE FIGURES

DETAILED ACCOUNT OF WORKING EMBODIMENT OF THE INVENTION

Figure 1:
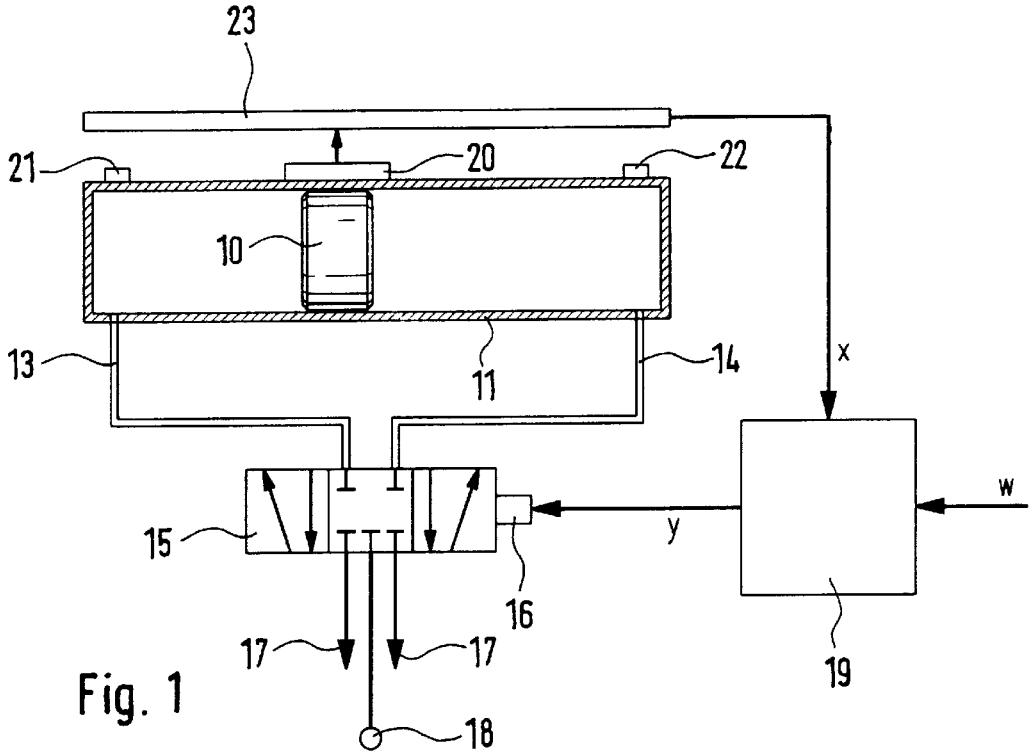
FIG. 1 shows a diagrammatic view of one embodiment of the invention with a double acting cylinder and a 5/3 proportional valve.

In the case of the embodiment of the invention diagrammatically illustrated in FIG. 1 a piston 10 is adapted to run in a double acting cylinder 11. From both ends of the cylinder 11 pressure lines 13 and 14 extend leading to a 5/3 proportional valve 15, which for setting a clearance cross section corresponding to an analog electrical input signal possesses a corresponding actuating member 16 at the outlet of the valve. In the neutral position illustrated the two pressure lines 13 and 14 are connected with venting lines 17. A source 18 of pneumatic or hydraulic pressure is in this neutral position separated from the cylinder 11.

The setting of the valve position is performed and, respectively, regulated with the aid of an electronic regulating means 19. In the one setting direction there is a displacement of the piston by the action of pressure on the one side of the piston in the one direction and in the other direction of setting by the action of pressure on the other side of the piston. Such a proportional valve is for instance available from the assignee with the designation MPYE-5-1/8.

The piston 10 drives a slide 20, which moves between two fixed abutments 21 and 22, whose position can also be changed. The drive of the slide 20 by the piston 10 is either with the aid of a magnetic coupling, by means of a mechanical direct connection through the slot in the cylinder 11 in the form of a slotted cylinder or using a piston rod, not illustrated, which is connected on the outside with the slide 20.

A positioning sensor gate 23 for detection of the actual position of the slide 20 and, respectively, of the piston 10 is in the present example constituted by a linear potentiometer and extends essentially along the cylinder 11. If only the two terminal positions of the piston 10 are to be approached with a regulating or damping action, the position sensor gate 23 may extend along only along the two terminal parts. The signal representing the actual position of the slide 20 is supplied as an actual value signal x to the electronic regulating means 19. Furthermore the electronic regulating means 19 is supplied with a desired value signal w corresponding to the desired position of the piston 10, or such signal is formed in such regulating means. From these signals the setting factor y is formed in the electronic regulating means for setting the proportional valve 15.

The formation of the setting factor y from the actual value signal x and the desired value signal w will now be explained in detail with reference to FIG. 2. The basic position regulation system is such that the actual value signal x is compared in a sum point 24 with the desired value signal w. The difference is supplied to a second sum point 25, where a speed and acceleration-dependent correction is performed. This correction is such that from the actual value signal x a piston speed-dependent signal $\dot{x}$ is formed in a first differentiating stage 26. In a second differentiating stage 27 a signal $\ddot{x}$ is formed dependent thereon on the acceleration of the piston. The speed-dependent signal $\dot{x}$ is subjected to a regulation gain factor K1 in a first multiplication stage 28 and the acceleration-dependent signal $\ddot{x}$ is subjected to a second regulation gain factor K2 in a second multiplying stage 29. In the second sum point 25 the factors K1 and K2 subjected to these regulation gain factors are taken into account subtractively.

The output signal of the second sum point 25 is subjected to a further regulation gain factor K0 in a third multiplying stage 30. In a following third sum point 31 an offset signal OF is taken into account as a correction factor in order to finally obtain the setting factor Y for the proportional valve 15.

The regulating means as described means that the respectively selected desired position is so approached with a damping effect that by suitable braking the piston comes precisely to a halt in the desired position without there being any overshooting of the terminal position or a hard impact resulting. All this is ensured by the speed- and acceleration-dependent effect of the regulation means.

In order to brake the piston, which is accelerated extremely rapidly up to the desired speed, prior to reaching the desired position firstly the outlet cross section is reduced more and more by suitable operation of the proportional valve 15, an even sharper braking being caused by reversing the proportional valve 15 so that a reverse pressure is built up involving the action of the pressure medium source 18. These two measures may be employed alternatively or in addition to each other, pulsed operation of the proportional valve 15 also being possible.

The regulation of position may be related to the two terminal abutments or also all intermediate positions. When the piston reaches two terminal position, it is fixed in this terminal position by the action of pressure. For locking in the intermediate positions, the two piston sides are acted upon by a pressure and/or mechanical locking in position is performed.

In the electronic regulating means 19 a learn mode is possible, which is for example performed the first time the apparatus is put into use. First in a static learn mode the first and second terminal positions are detected. For this purpose the piston 10 is inched into the two terminal positions in sequence until the slide 20 engages the respective fixed abutment 21 and, respectively, 22. At least one fixed abutment 21 and, respectively, 22 may here as well be arranged in a position departing from one terminal position. The respective position is then stored in the electronic regulating means 19 and a desired position w. After the storage of the two terminal positions dynamic learning is performed (adaptation). Here the movement behavior is optimized. The piston 10 is then driven into the one or both terminal positions while subject to the regulating action and prior to reaching these terminal positions is braked in a first coarse adjustment step, in which the regulation gain factors firstly have a basic setting. In the case of excessively early or excessively late braking the regulation gain factors and the offset signal are automatically adapted until optimized braking behavior has been achieved.

The regulation gain factors may be set or preset as well by-means of DIL switch coding. For retrieving the table data for the three regulation gain factors it is possible for example to take into account the mass of the piston and slide, the type of cylinder, the length of the cylinder and the cross section of the cylinder as parameters.

Figure 2:
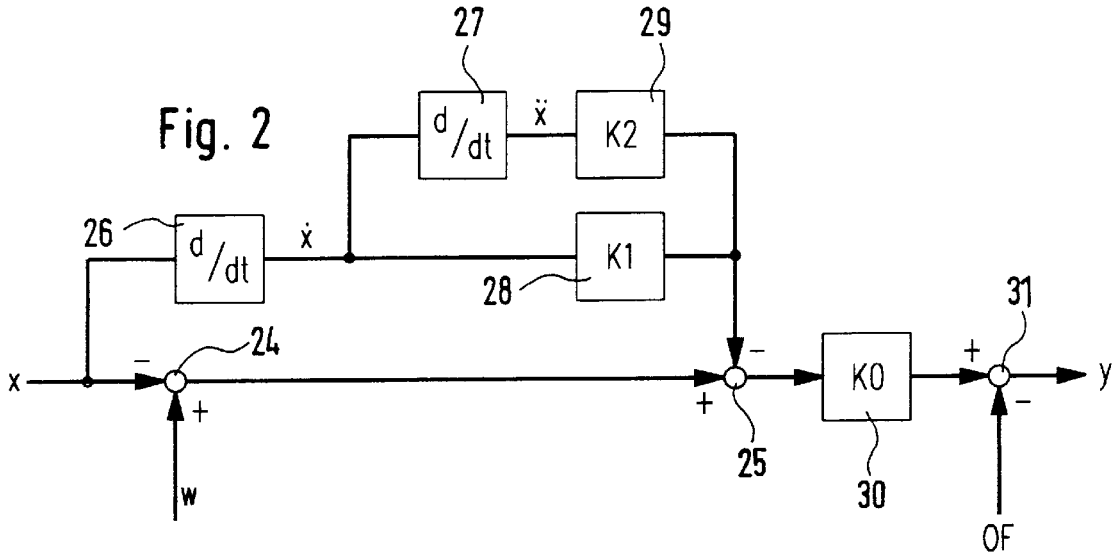
FIG. 2 shows a block circuit diagram for explanation of the manner of working of position regulating means.

The regulating means illustrated in FIG. 2 may for example be based on the use of a micro-controller.

During operation automatic adaptation may be adhered to, that is to say, changes in sliding properties, masses, signs of aging or the like may be taken into account continuously in order for example to compensate by resetting the offset value OF. In the primary learn mode as well it is possible for the offset value to be set and, respectively, changed.

What is claimed is:

1. An apparatus for the damped positioning of a piston running in a cylinder comprising:

a sensor operatively connected to an electronic regulating device for detecting a piston position, and generating an actual position value signal;

a valve adapted to be regulated by the regulating device, the valve regulating braking of the piston prior to the piston reaching a desired position by influencing opposing pressure in a cylinder outlet side; and a position regulating device being modifiable by a value dependant on the speed of the piston and a value dependant on the acceleration of the piston for forming a setting quantity for the valve, wherein the value dependant on the speed is derived by differentiating the actual position value signal and the value dependant on the acceleration is derived by differentiating the value dependant on the speed.

2. The apparatus as set forth in claim 1, wherein a position error signal is linked with the value dependant on the speed and with the value dependent on the acceleration.

3. The apparatus as set forth in claim 1, wherein the value dependant on the speed or the value dependant on the acceleration or a value of a modified regulation gain factor is linked multiplicatively with a regulation gain factor.

4. The apparatus as set forth in claim 3, wherein the regulation gain factors are able to be set by setting elements on the basis of tables.

5. The apparatus as set forth in claim 1, wherein the value of the modified error signal is additively or subtractively linked with an offset value.

6. The apparatus as set forth in claim 1, wherein the valve includes a proportional valve.

7. The apparatus as set forth in claim 6, wherein the valve in the form of a proportional valve is connected with the two terminal portions of the cylinder by lines.

8. The apparatus as set forth in claim 1, wherein for affecting the outlet opposite pressure by the valve arrangement, the outlet cross section is reduced.

9. The apparatus as set forth in claim 1, wherein the electronic regulation device has a first learn mode for two terminal positions as set by a plurality of fixed abutments.

10. The apparatus as set forth in claim 9, comprising first control means for sequentially approaching the two terminal positions and storage of the terminal position values as detected in the corresponding abutment positions.

11. The apparatus as set forth in claim 9, wherein the terminal positions are able to be reset by changing the position of the fixed abutments.

12. The apparatus as set forth in claim 9, wherein the electronic regulating has a second learn mode for setting optimum braking behavior.

13. The apparatus as set forth in claim 12, wherein either the value dependent on the speed or the value dependent on the acceleration or the value of the modified regulation gain factor is linked multiplicatively with a regulation gain factor and wherein the setting to optimize braking behavior is performed by suitably presetting the regulation gain factors.

14. The apparatus as set forth in claim 1, wherein the electronic regulating device comprises a triple loop state regulator.

15. The apparatus as set forth in claim 1, wherein the sensor for detecting the piston position is a linear potentiometer.

16. An apparatus for the damped positioning of a piston running in a cylinder comprising:

a sensor operatively connected to an electronic regulating device for detecting a piston position and generating an actual position value signal;

a valve adapted to be regulated by the regulating device, the valve regulating braking of the piston prior to the piston reaching a desired position by influencing opposing pressure in a cylinder outlet side; and a position regulating device being modifiable by a value dependant on the speed of the piston and a value dependent on the acceleration of the piston for forming a setting quantity for the valve, wherein the value dependant on the speed or the value dependant on the acceleration of the piston or a value of a modified regulation gain factor is linked multiplicatively with a regulation gain factor.

17. The apparatus as set forth in claim 16, wherein the value dependant on the speed and the value dependent acceleration and a value of a modified regulation gain factor is linked multiplicatively with a regulation gain factor.

18. An apparatus for the damped positioning of a piston running in a cylinder comprising:

a sensor operatively connected to an electronic regulating device for detecting a piston position and generating an actual position value signal;

a valve adapted to be regulated by the regulating device, the valve regulating braking of the piston prior to the piston reaching a desired position by influencing opposing pressure in a cylinder outlet side;

a position regulating device being modifiable by a value dependant on either the speed and acceleration of the piston for forming a setting quantity for the valve; and wherein the electronic regulation device has a first learn mode for two terminal positions as set by a pair of fixed abutments, the first learn mode including a first control means for sequentially approaching each of the two terminal positions and storage of the terminal position values as detected in corresponding abutment positions.

19. The apparatus as set forth in claim 18, wherein the electronic regulating device has a second learn mode for setting optimum piston braking behavior.

* * * * *